252-103 AU 166 EX
9/26/78 OR 4,116,850

United States Patent [19]
Ruck

[11] 4,116,850
[45] Sep. 26, 1978

[54] DRAIN OPENER

[75] Inventor: J. Barry Ruck, Tampa, Fla.

[73] Assignee: Theochem Laboratories, Inc., Tampa, Fla.

[21] Appl. No.: 789,534

[22] Filed: Apr. 21, 1977

[51] Int. Cl.[2] ..... C11D 7/54
[52] U.S. Cl. ..... 252/103; 252/95; 252/156; 134/2; 134/40; 134/42
[58] Field of Search ..... 252/95, 103, 156; 134/2, 40, 42

[56] References Cited

U.S. PATENT DOCUMENTS

| | | | |
|---|---|---|---|
| 2,997,444 | 8/1961 | Martin | 252/156 |
| 3,671,440 | 6/1972 | Sabatelli et al. | 252/103 |
| 3,697,431 | 10/1972 | Summerfelt | 252/156 X |
| 3,791,977 | 2/1974 | Ancel et al. | 252/103 X |
| 3,833,419 | 9/1974 | Weiss et al. | 136/2 X |

*Primary Examiner*—Mayer Weinblatt
*Attorney, Agent, or Firm*—Stein & Frijouf

[57] ABSTRACT

A drain opener composition and process comprising the application of an aqueous solution of a soluble metallic hydroxide, a chlorine releasing salt, and a catalyst to the clogged drain for fast opening of said drain.

4 Claims, No Drawings

DRAIN OPENER

BACKGROUND OF THE INVENTION

1. Field of the Invention

This invention relates to a drain opener and more particularly to a drain opener of the soluble metal hydroxide type.

2. Description of the Prior Art

Heretofore, drain openers consisted of four basic types: (1) inhibited sulfuric acid; (2) sodium or potassium hydroxide solutions; (3) sodium or potassium hydroxide with available chlorine such as sodium or calcium hypochlorite; and (4) sodium or potassium hydroxide pellets or flakes with flaked, chipped or powdered aluminum.

The sulfuric acid type was considered the best from the standpoint of overall efficiency. It had the ability to react with most types of organic obstructions quickly. However, its major disadvantage was its great danger of causing permanent injury if not properly used.

The sodium or potassium hydroxide types, whether liquid or dry, (No. 2, above), or when mixed with aluminum (No. 4, above), were effective against grease and greasy soil type clogs but had little effectiveness towards hair, paper, or fabric, quite often found in clogged systems.

The alkali-hypochlorite salt type (No. 3, above), degraded fibrous materials. Unfortunately, the chlorination and subsequent degradation was very slow, requiring a number of hours for dissolution to take place.

SUMMARY OF THE INVENTION

Objectives

An object of this invention is to provide a unique drain opener composition.

Another object is to provide a drain opener composition of fast action.

Still another object is to provide a drain opener composition which is safe.

A further object is to provide a drain opener composition which is economical.

A still further object is to provide a drain opener composition which is effective against grease, as well as hair, paper and fabric.

Other objects of the invention will in part be obvious and will in part appear hereinfater.

BROAD DESCRIPTION OF THE INVENTION

In accord with the above objectives, a unique composition for drain opening has now been found. It comprises 10–60% by weight of a soluble metallic hydroxide, 0.1–15.0% by weight of a chlorine releasing salt, and 0.01–10.0% by weight of a catalyst selected from the metallic chlorides of the period six metals of the periodic table of the elements, such as, for example, barium, cesium, platinum, gold.

The invention accordingly comprises the several steps and the relation of one or more of such steps with respect to each of the others, and the composition possessing the features, properties and the relation of components which are exemplified in the following detailed disclosure and the scope of the invention will be indicated in the claims.

DETAILED DESCRIPTION OF THE PREFERRED EMBODIMENTS

For a fuller understanding of the nature and objects of this invention, reference should be had to the following detailed examples:

EXAMPLE I

The following ingredients are admixed to form a drain opening solution:

| | % by weight |
|---|---|
| Potassium hydroxide (45% Aq. Sol.) | 50.00 |
| Trichloroisocyanuric acid | 1.00 |
| Barium Chloride | 0.05 |
| Water | 48.95 |
| | 100.00 |

The potassium hydroxide is the soluble metallic akali, the trichloroisocyanuric acid is the chlorine releasing salt and the barium chloride is the catalyst.

EXAMPLE II

The following ingredients are admixed to form another drain opening solution:

| | % by weight |
|---|---|
| Potassium hydroxide (45% aq. sol.) | 50.00 |
| Calcium hypochlorite | 1.00 |
| Barium chloride | 0.05 |
| Water | 48.95 |
| | 100.00 |

In the above Example, calcium hypochlorite is the chlorine releasing salt.

TEST PROCEDURES

When tests are run using the compositions of Examples I and II as compared to a non-chlorinated drain opener, and a chlorinated non-catalyzed drain opener, the quickness of the action is observed. When the test is run under equal conditions by suspending 0.5 gm. of human hair in 50 ml. of distilled water and adding 50 ml. of each test product respectively, the time for complete dissolution of the hair was noted as follows:

| Product | Dissolution Time |
|---|---|
| Of Example I | 6 minutes |
| Of Example II | 14 minutes |
| Non-chlorinated drain opener | No effect, after 8 hours (liquid Draino) |
| Chlorinated, no catalyst drain opener | 1 hour (liquid PlumR) |

It should be evident from the above that the catalyst provides, in one instance, a ten-fold increase, and in the second instance, a four-fold increase in time to open. Thus a substantial improvement has been shown.

EXAMPLE III

The following ingredients were admixed:

| | % by weight |
|---|---|
| Potassium Hydroxide (45% aq. sol.) | 50.00 |
| Calcium Hypochlorite | 1.00 |
| Barium Chloride | 0.05 |
| Nonylphenoxypolyethylene oxyethanol | 0.50 |
| Water | 48.45 |

-continued

| | % by weight |
|---|---|
| | 100.00 |

EXAMPLE IV

The following ingredients were admixed:

| | |
|---|---|
| Sodium Hydroxide | 40.00 |
| Trichloroisocyanuric Acid | 1.00 |
| Barium Chloride | 0.10 |
| Water | 58.90 |
| | 100.00 |

EXAMPLE V

The following ingredients were admixed:

| | |
|---|---|
| Sodium Hydroxide | 40.00 |
| Sodium Hypochlorite | 4.50 |
| Barium Chloride | 0.05 |
| Water | 55.45 |
| | 100.00 |

EXAMPLE VI

The following ingredients were admixed:

| | % by weight |
|---|---|
| Ammonium Hydroxide | 40.00 |
| Calcium Hypochlorite | 1.00 |
| Barium Chloride | 0.05 |
| Water | 58.95 |
| | 100.00 |

EXAMPLE VII

The following ingredients were admixed:

| | |
|---|---|
| Potassium Hydroxide (45% aq. sol.) | 50.00 |
| Calcium Hypochlorite | 1.00 |
| Platinum Chloride | 0.05 |
| Water | 48.95 |
| | 100.00 |

EXAMPLE VIII

The following ingredients were admixed:

| | |
|---|---|
| Potassium Hydroxide (45% aq. sol.) | 50.00 |
| Trichloroisocyanuric Acid | 1.00 |
| Cesium Chloride | 0.05 |
| Water | 48.95 |
| | 100.00 |

EXAMPLE IX

The following ingredients were admixed:

| | % by weight |
|---|---|
| Sodium Hydroxide | 40.00 |
| Sodium Hypochlorite | 4.00 |
| Gold Chloride | 0.10 |
| Water | 55.90 |
| | 100.00 |

EXAMPLE X

The following ingredients were admixed:

| | |
|---|---|
| Ammonium Hydroxide | 20.00 |
| Calcium Hypochlorite | 4.50 |
| Barium Chloride | 5.00 |
| Nonylphenoxy polyethyleneoxyethanol | 1.00 |
| Water | 69.50 |
| | 100.00 |

EXAMPLE XI

The following ingredients were admixed:

| | |
|---|---|
| Potassium Hydroxide (45% aq. sol.) | 93.00 |
| Sodium Hypochlorite | 5.00 |
| Barium Chloride | 2.00 |
| | 100.00 |

It will thus be seen that the objects set forth above, among those made apparent from the preceding description, are efficiently attained and, since certain changes may be made in carrying out the above process and in the composition set forth without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described:

What is claimed is:

1. A drain opening composition consisting essentially of 10–60% by weight of a water-soluble hydroxide selected from the group of ammonium and alkali metal hydroxides, 0.1–15.0 by weight of a chlorine releasing agent, and 0.01–10% by weight of a compound selected from the group consisting of the chlorides of the period six metals of the periodic table of the elements.

2. The drain opening composition of claim 1 wherein said hydroxide is potassium hydroxide, said chloride releasing salt is trichlorisocyanuric acid and said compound is barium chloride.

3. The drain opening composition of claim 1 wherein said hydroxide is potassium hydroxide, said chlorine releasing salt is calcium hypochlorite and said compound is barium chloride.

4. A process of opening a clogged drain, comprising the application of a solution of the drain opening composition of claim 1.

* * * * *